US005180064A

United States Patent [19]

Elvin-Jensen

[11] Patent Number: 5,180,064

[45] Date of Patent: Jan. 19, 1993

[54] CONTAINER

[76] Inventor: Flemming Elvin-Jensen, 4655 Woodgreen Drive, West Vancouver, British Columbia, Canada, V7S 2V4

[21] Appl. No.: 763,742

[22] Filed: Sep. 23, 1991

Related U.S. Application Data

[63] Continuation-in-part of Ser. No. 639,055, Jan. 9, 1991.

[30] Foreign Application Priority Data

Sep. 24, 1990 [AU] Australia ..... PK2442

[51] Int. Cl.[5] ..... B65D 19/00

[52] U.S. Cl. ..... 206/598; 206/599; 220/675

[58] Field of Search ..... 206/599, 598; 220/675

[56] References Cited

U.S. PATENT DOCUMENTS

| | | | |
|---|---|---|---|
| 3,948,190 | 4/1976 | Cook, III et al. | 206/599 |
| 4,000,704 | 1/1977 | Griffin, Jr. | 206/599 |
| 4,339,040 | 7/1982 | Peil et al. | 206/599 |
| 4,375,265 | 3/1983 | van de Wetering et al. . | |
| 4,413,737 | 11/1983 | Wind | 206/599 |
| 4,480,748 | 11/1984 | Wind | 206/599 |

*Primary Examiner*—Joseph Man-Fu Moy

*Attorney, Agent, or Firm*—Bell, Seltzer, Park & Gibson

[57] ABSTRACT

A bulk container comprises a base and sidewalls and the base includes openings for the times of a forklift truck. Each opening has edge portions which slope up to the sidewalls to form an entrance. Such entrance includes a vertical height being greater than the rest of the opening below the base and reinforcing ribs extending along the underside of the edge portion.

7 Claims, 4 Drawing Sheets

FIG. 1

CONTAINER

This is a continuation-in-part of copending U.S. patent application Ser. No. 07/639,055 filed: Jan. 9, 1991.

FIELD OF THE INVENTION

This invention relates to bulk containers.

BACKGROUND OF THE INVENTION

This invention is concerned with a bulk container of the kind used in storage of materials, which container is normally transported from location to location by a fork lift truck and which comprises sidewalls and a base, with a recess or opening in its lower portion below the base, said recess or opening being capable of receiving the "tines" of a fork. Such a bulk container is hereinafter called a "container of the kind set forth".

U.S. Pat. No. 4,375,265 (van de Wetering) discloses a container of the kind set forth comprising foamed plastic. On the underside of and covering the area of the container are ribs running parallel to the sides, the outmost of which ribs form in effect continuations of the vertical walls of the container. The base of the container is flat and is connected to such walls by very small radiussed corners. Short stiffeners are provided for the ribs. At the entrance to the recesses, there are two such stiffeners that run in the direction of the recesses and extend both inwardly and outwardly to the end of horizontal outwardly extending ribs that reinforce the outside of the container. The forward ends of these stiffeners are tapered in an attempt to ensure that the entering ends of the forks do not engage the transverse ribs to cause the container to be moved but instead slide underneath the ribs. The taper may be at thirty-five to forty-five degrees.

While the tapered front ends of the stiffeners serve to enlarge the entrance to the recess, the enlargement is perforce no greater than the height of the stiffeners and furthermore the incline of the taper is such that there is a very significant probability that the tines will engage the stiffeners fairly flat on and damaging them. Thus the effect of these stiffeners is limited.

SUMMARY OF THE INVENTION

According to one aspect of the invention there is provided a container of the kind set forth having ribs on its underside running in the direction of the recesses characterized in that the base of the container has edge portions that slope up to the side walls, preferably by being of enlarged radius, and that ribs extend along the underside of such portions. The height of the ribs may increase along such portions towards the ends of such portions and preferably extend beyond the side walls to provide an enlarged opening for the recesses. This enlarged opening may extend higher than the height of the base of the container and the decrease in height can be smooth to minimize the possibility of there being a butting engagement of the ends of the tines with the edges of the ribs.

An embodiment of the invention will now be described by way of example with reference to the accompanying drawings.

DESCRIPTION OF THE PREFERRED EMBODIMENT

Figure 4:
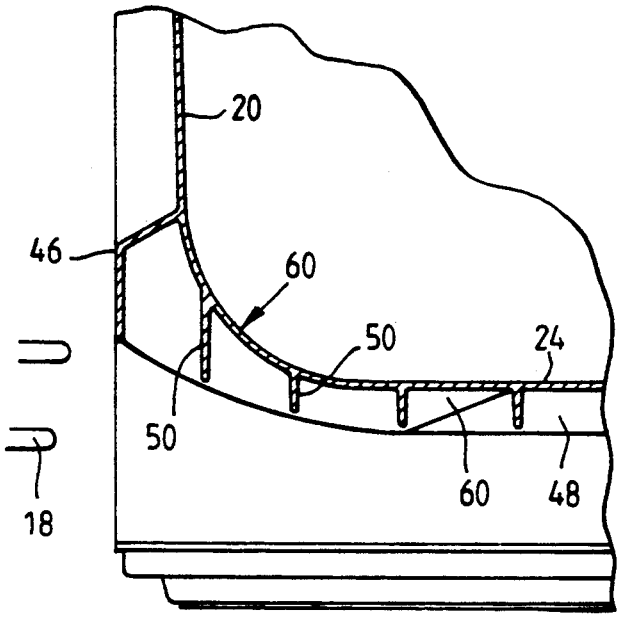
FIG. 4 is a section on line 4—4 of FIG. 1.

Referring now to the drawings, there is shown a one piece moulded polyethylene bulk container 10 for use for example by farmers and others who store farm produce such as apples. The container 10 comprises a container space 12 mounted on three legs 14*a*, 14*b* and 14*c* that extend from front to rear of the container and leave two spaces or recess 16 therebelow for the insertion of the tines of a fork lift truck (shown schematically at 18 in FIG. 4).

The containment space 12 is defined by front and rear walls 20, side walls 22 (all of which are hereinafter referred to as the "containment walls") and a base 24.

Figure 3:
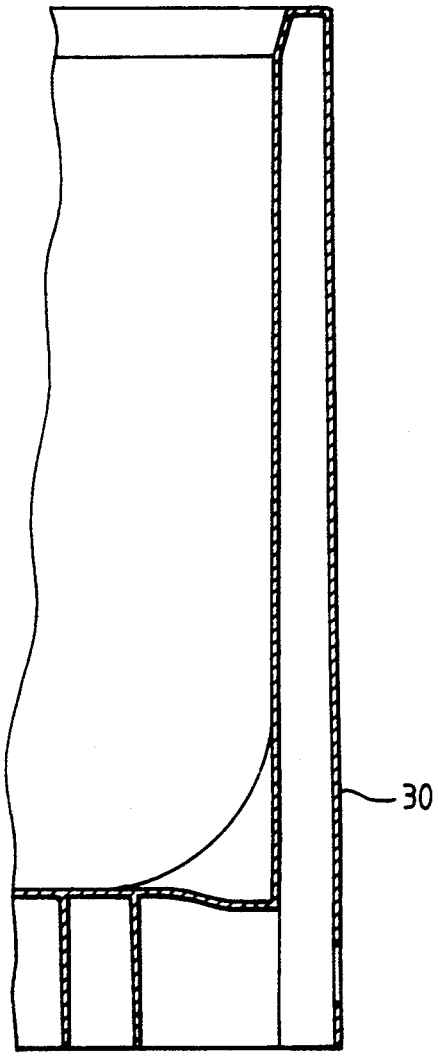

The containment walls are reinforced by vertical corner members 26 and center member 28. These center and corner members are constituted by outer and joining walls 30 and 32. The outer walls 30 run parallel to and spaced (by about 40 mm) from the containment walls (as is best shown in FIG. 3). These walls 30 run downwardly and merge into the outer walls 34 of the outer legs 14*a* and 14*c*. An internal corner or gusset 36 is provided at the vertical corners of the containment walls.

Four spaced, outwardly directed, horizontal flanges 38 are provided at the upper edges of the containment walls extending between the center and corner member 28 and 26. Between the two uppermost flanges 38, the containment walls are outwardly inclined as indicated at 40.

Between the corner and center members 26 and 28, the containment walls are perforated at 42 to provide ventilation for the containment space. An outwardly and downwardly inclined wall 44 extends from the lower end of each of the side walls 22 slightly above the base 24 between members 26 and 28 and this inclined wall 44 merges with the outer wall 34 of the outer legs 14*a* and 14*c*.

The front and rear walls 20 are generally similar to the side walls 22 but are somewhat less wide. At their lower edges there are horizontal flange members 46 having outer faces which connect and merge with the outer faces of the corner and center members at these walls 20.

The underside of the base 24 is reinforced by vertical longitudinal reinforcing ribs 48, that run parallel to the feet 14, and transverse ribs 50. The ribs 48 and 50 taper slightly to facilitate demoulding of the container. They are typically of 4 mm width at their lower end and about 34 mm high.

Two inner walls 52 for the outer feet 14*a* and 14*c* are provided. Center walls 54 of lesser length and depth than walls 52 are provided respectively between the walls 34 and 52 of the outer feet. Two inner feet defining walls 56, merging with the joining walls 32 of the center members of each of the front and rear walls, extend from the base 24 and there is a center wall 57 (similar to center walls 54) midway therebetween.

Longitudinal slots 58 are provided between the ribs 48 to permit air flow to the contents of the container.

The base 24 has edge portions 36 of enlarged radius corner connections 60 and 61 respectively with the front and rear walls 20 and the side walls 22. Conveniently such radius is of the order of 60 mm (slightly more than two and a quarter inches) at the side walls (indicated at 62) and 125 mm (just under five inches) at the front walls (indicated at 60). Below the radius connection to the front and rear walls, the longitudinal ribs 48 are supplemented by intermediate reinforcing ribs 64 located midway therealong to create an integral slide entry. The longitudinal ribs 48 and 64 run around the underside of the corner connections 60 at the recesses 16. The lower edges of the ribs 48 and 64 lie on an arc that (a) is centered on a point spaced above and inwardly of the center of the radius 60 at the front walls and (b) has a larger radius than the radius of the such portion. The ribs 48 and 64 extend beyond the front and rear walls 20 to the front of the outer faces of the corner and center members at these walls 20. Typically the radius of the edges of the ribs 48 and 64 is 330 mm (just under twelve inches). Thus the height of the ribs off the ground increases outwardly of the container 10. In the particular embodiment mentioned, the opening height of the recess i.e. the height of the ribs 32 above the ground (or as will often occur in practice, the height of such ribs above the upper edge of another container on which the container is stacked) is increased from 122 mm (4.8 inches) to 185 mm (slightly more than seven and a quarter inches). At the front of the recess, the tangent to the undersides of the ribs 48 and 64 are sloped at about 35° (thirty-five degrees) to the horizontal and this slope decreases as these uppersides eventually become horizontal about 194 mm (one hundred and ninety-four millimeters) (slightly more than 7½ inches) from the entry to the recess 16. At its uppermost position, the opening at the recess 16 is located about 65 to 75 mm (two and half to three inches) above the height of the base 24 of the containment 12.

At the portion of the base below the radius, the transverse ribs 50 are of smaller depth than the longitudinal ribs 48 and 64 so as not to form a possible obstacle to the tines 18 of the fork lift truck.

This increased height and the smoothly sloping and mostly very shallowly inclined underside of the ribs 48 and 64 provides a significantly improved opening and guide for the tines 18 into the recess which considerably simplifies the task of the fork lift truck operator and to reduce damage to the underside of the container 10. Furthermore the shallowly inclined underside of the ribs enables the tines more easily to lift the container as the tines move deeper into the recesses 16 (if the tines do engage the ribs 48 and 64).

Furthermore, it would be noted that because of the large internal radius, taller ribs are provided at the mouths of the recesses. Further as the container is intended to contain agricultural and like products which are generally spherical such as apples, the volume of the containment space will not be reduced significantly or at all from a practical point of view.

It will also be noted that there are no reinforcing means between the horizontal flanges 30. Thus the upper portions of the walls will be rather flexible and will be able to accommodate a fair amount of movement should the ends of the tines of a fork lift truck strike them.

The ribs 48 are placed at about 47 mm centers and the ribs 48 and 64 are at 24.5 mm centers. There are a large number of longitudinal ribs 48 and 64 at each recess, being conveniently fourteen such ribs at each recess 16 thus providing a substantial amount of material to engage the tines 18 if necessary. Thus a robust integral slide entry is provided.

Figure 1:
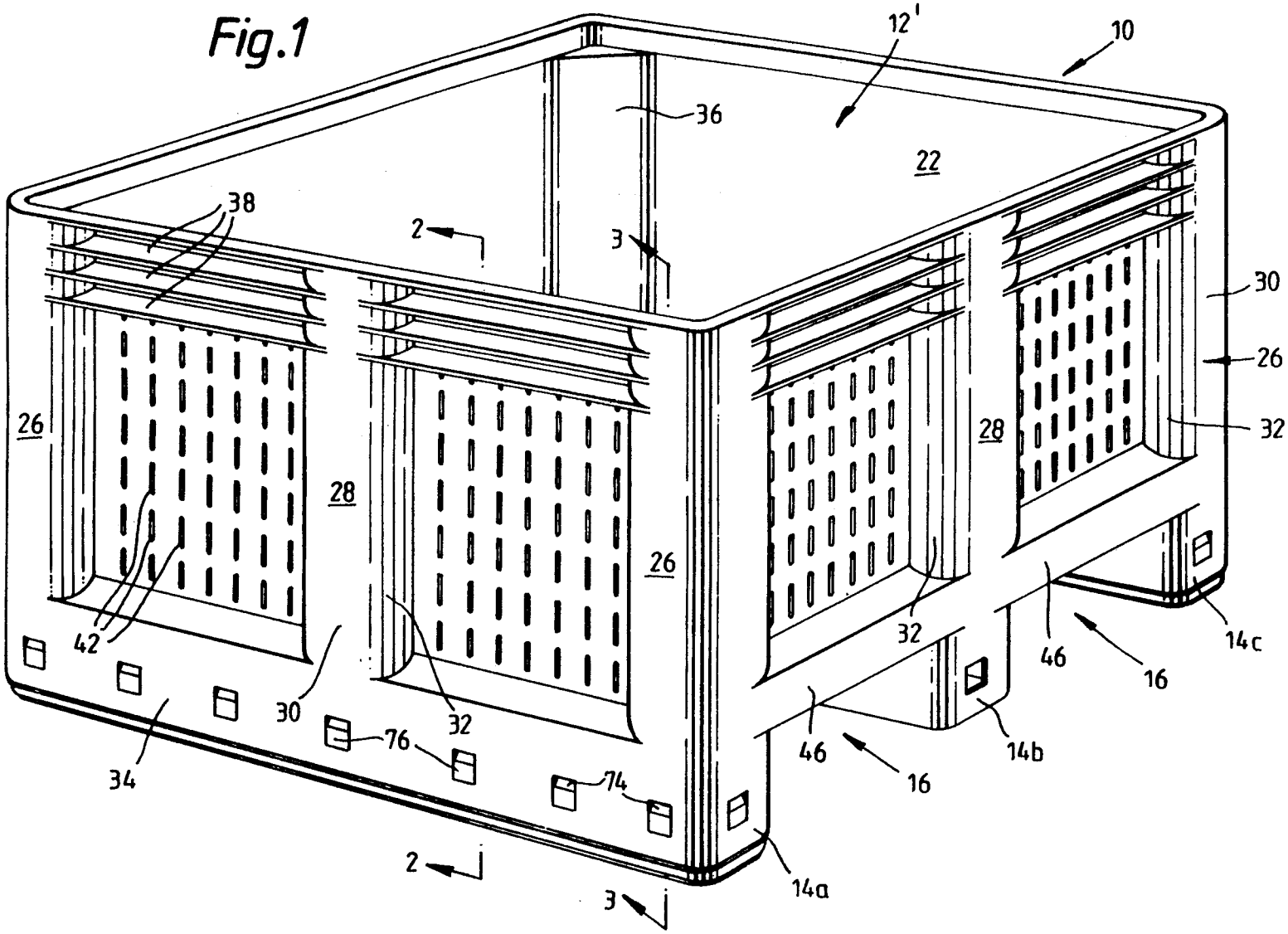
FIG. 1 is a perspective view of a bulk container of the invention.
Figure 2:
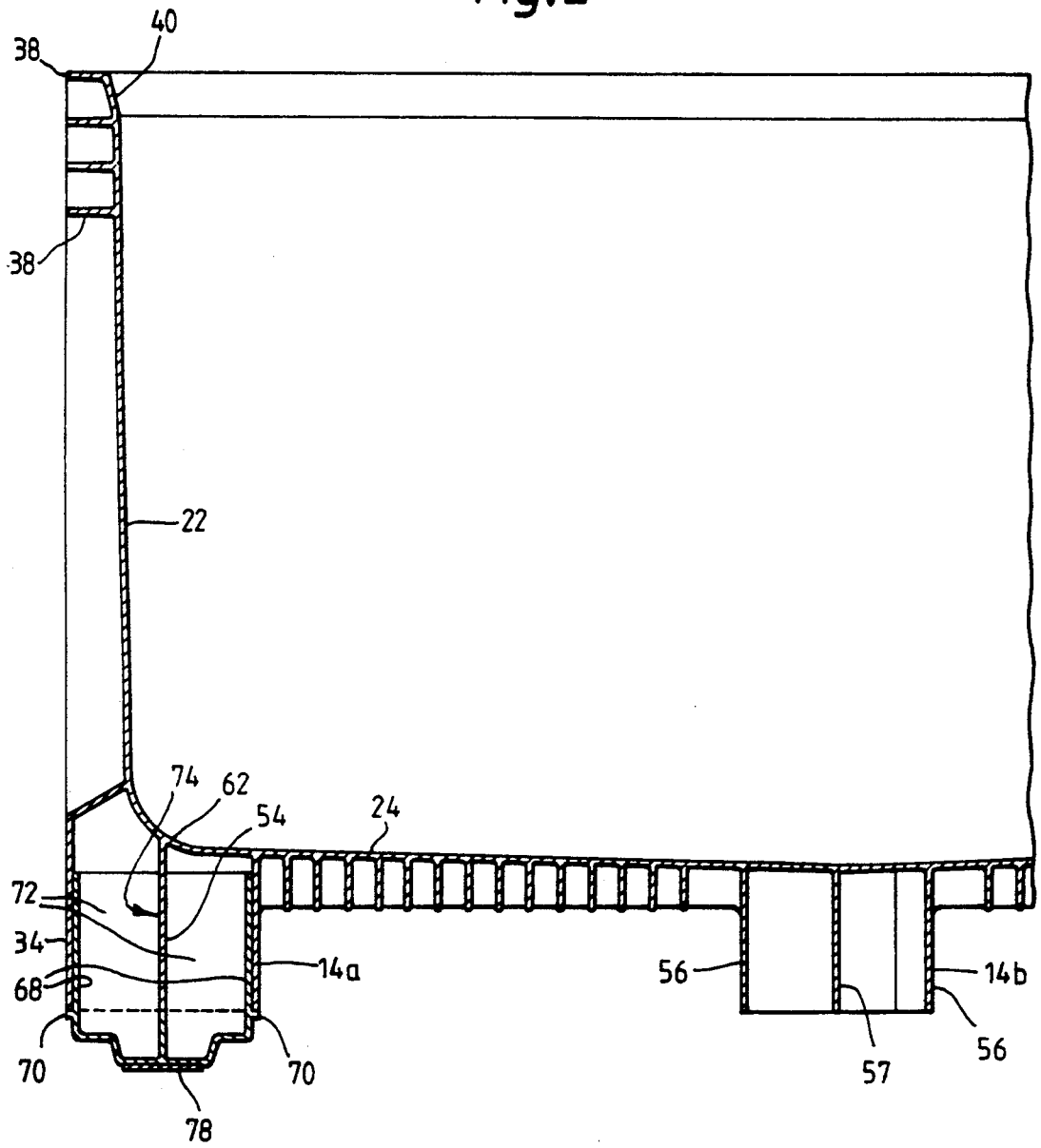
FIGS. 2 and 3 are respectively sections on lines 2—2 and 3—3 of FIG. 1.
Figure 6:
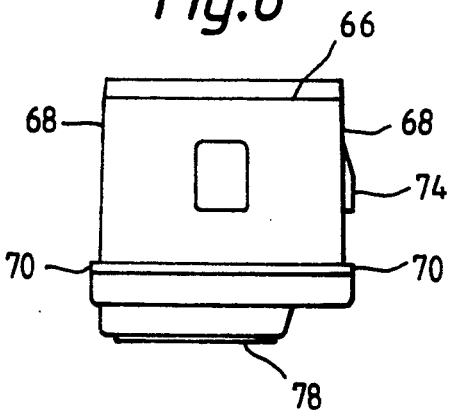
FIG. 6 is an end elevation of a foot used in the container.
Figure 5:
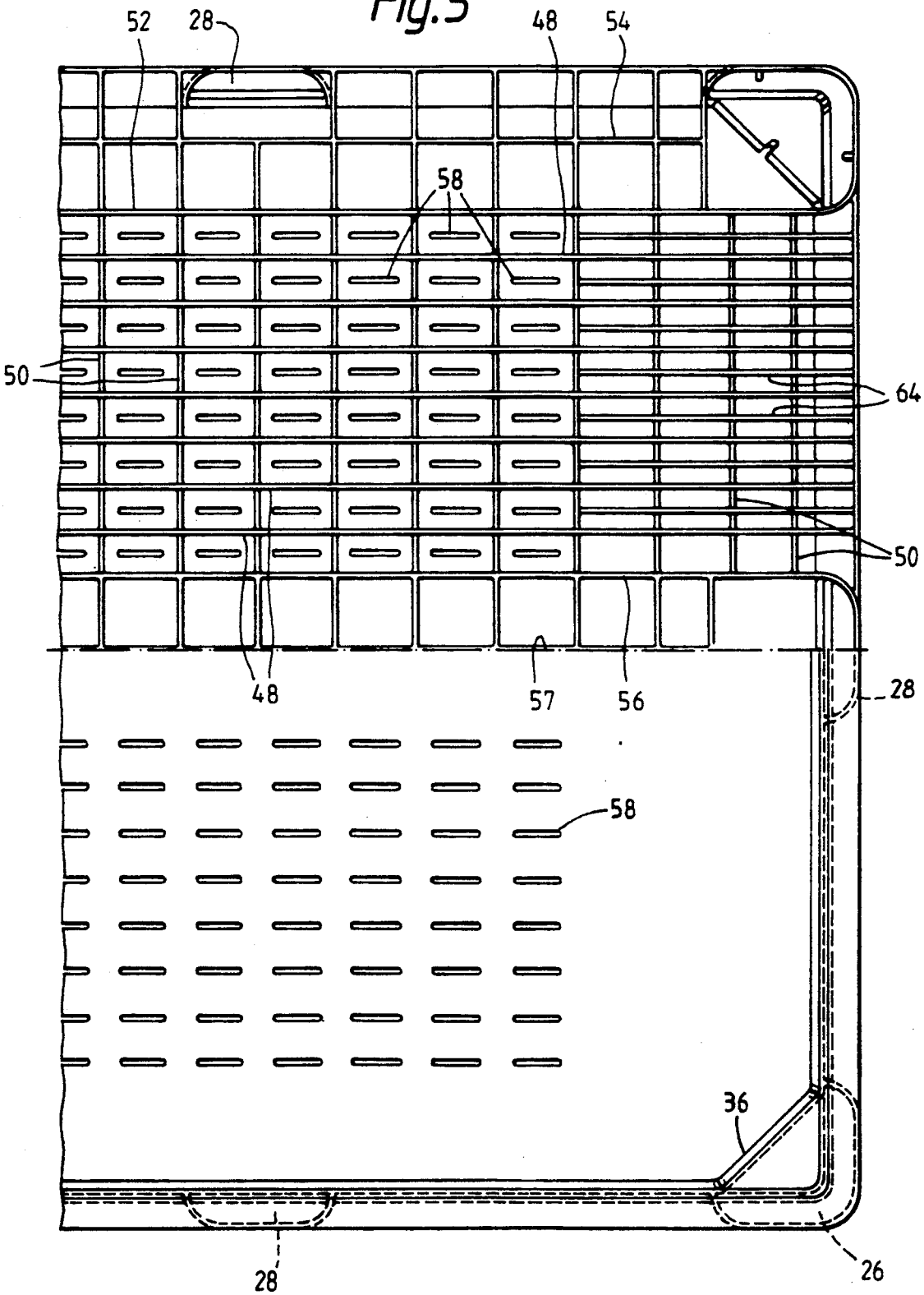
FIG. 5 is a complex view, one half being a top plan and the other half being an underplan of the container.

The legs 14 of the container 10 contain channel section feet 66 (see FIGS. 2 and 6). These feet 66 have vertical side walls 68 that fit closely within the side walls 34 and 52 of the outer legs and of the center leg. The walls 68 are provided with low horizontal ribs 70 to prevent the feet 66 slipping too deeply into the legs 14. There are internal transverse walls 72 along the midsection of the feet 66 and these walls 72 each have a vertical slot to receive therein the center walls 54 or 57. In addition, the side walls 68 are provided with protrusion members 74 that project through windows 76 formed in the sides and ends of legs 14 to prevent the feet 66 from being withdrawn. Further, non-slip pads 78 are conveniently inserted into the base of each foot 66.

The invention is not limited to the precise constructional details hereinbefore described and illustrated and modifications thereto can be made within the spirit and scope of the following claims. For example the various dimensions mentioned above may vary as required. The shape of the container may be altered.

The ventilation slots may be omitted from the base and or some or all of the sides of the container.

The container can be put to other uses and may be used to contain fish, and engineering or other products.

That which is claimed is:

1. A bulk container of the kind used in storage of materials which container is normally transported from location to location by a forklift truck and which comprises containment walls and a base with an opening of predetermined height in its lower portion below the base, said opening being capable of receiving the "tines" of a fork, there being ribs on the underside of the container in said opening and running the direction of the opening characterized in that the base of the container has edge portions which slope up to the containment walls to thereby form an entrance to said opening, said entrance having a vertical height greater than said predetermined height of said opening below the base, and that said ribs extend along the underside of said edge portion.

2. A container as claimed in claim 1 wherein the edge portions are of enlarged radius.

3. A container as claimed in claim 1 in which the height of the ribs increases along such portions towards the ends of such portions.

4. A container as claimed in claim 1 in which said ribs extend beyond the walls.

5. A container as claimed in claim 1 wherein the upper edges of the ribs lie upon an arc centered on a line parallel to the side wall.

6. A container as claimed in claim 5 wherein the radius of the said arc on which the said lower edges of the ribs lie in substantially greater than the radius of the edge portions.

7. A container as claimed in claim 1 characterized in that the upper portions of the sidewalls are capable of flexing inwardly in the event that they are engaged by the ends of the tine.

* * * * *